United States Patent [19]

Grabbe et al.

[11] Patent Number: 4,469,389

[45] Date of Patent: Sep. 4, 1984

[54] ROTATABLE CAM ACTUATED CONNECTOR FOR CIRCUIT BOARD EDGE

[75] Inventors: Dimitry Grabbe, Lisbon Falls, Me.; Johannes C. W. Bakermans, Harrisburg, Pa.; Nicola Cosmo, Harrisburg, Pa.; Iosif Korsunsky, Harrisburg, Pa.

[73] Assignee: AMP Incorporated, Harrisburg, Pa.

[21] Appl. No.: 395,563

[22] Filed: Jul. 6, 1982

[51] Int. Cl.[3] ..... H01R 9/09

[52] U.S. Cl. ..... 339/75 MP; 339/176 MP; 339/17 CF

[58] Field of Search ..... 339/74 R, 75 MP, 176 MP, 339/17 CF

[56] References Cited

U.S. PATENT DOCUMENTS 4,077,688 3/1978 Cobaugh et al. ..... 339/74 R 4,266,839 5/1981 Aikens ..... 339/75 MP 4,268,102 5/1981 Grabbe ..... 339/75 M 4,354,729 10/1982 Grabbe et al. ..... 339/17 CF X

*Primary Examiner*—Z. R. Bilinsky

*Attorney, Agent, or Firm*—Gerald K. Kita; Donald M. Boles

[57] ABSTRACT

A miniature circuit board edge connector assembly includes an insulative housing 2, electrical spring blades 12A in the housing, conductor portions 12B pivotally interlocked with the spring blades 12A and pivotally impinged against corresponding conductive post portions 11, a cam 30 resiliently flexes the spring blades 12A, causing the conductor portions to pivot and engage circuit conductors 37 of a circuit board 38, and to provide circuit paths, from this circuit conductors 37 to the post portions 11, that are shorter than the lengths of the spring blades 12A.

10 Claims, 3 Drawing Figures

ROTATABLE CAM ACTUATED CONNECTOR FOR CIRCUIT BOARD EDGE

The invention relates to a zero insertion force connector assembly for a circuit board edge. There is known in U.S. Pat. No. 4,077,688, a connector assembly in which electrical contacts are flexed resiliently by a cam toward and away from electrical circuit conductors on a circuit board edge. Each contact of the assembly provides a circuit path. It is advantageous to miniaturize the contact to shorten its circuit path. However, shortening the contact would undesirably reduce its capability for resilient flexure. The present invention is a connector assembly that incorporates electrical contacts specifically of miniature size, and a cam that resiliently flexes the contacts toward and away from circuit conductors on an edge of a circuit board.

U.S. Pat. No. 4,268,102, discloses a connector assembly that includes an electrical contact having a conductive post portion and an integral spring loop. A conductor on the spring loop bridges between the post portion and a circuit conductor on an edge of a circuit board. The conductor provides a circuit path, from the post to the circuit board, that is shorter than the path provided by the spring loop. In this connector assembly, clamping pressure is applied to urge the circuit board against the contact to cause resilient flexure of the spring loop. In the present invention, an edge of a circuit board is seated on a ledge of an insulative connector housing. Electrical contacts within the housing are cammed in a direction away from the circuit board to permit seating or unseating of the circuit board without undue exertion of the circuit board against the contacts. The connector assembly of the invention incorporates electrical contacts, of which their respective electrical paths are shorter than their spring lengths, and a cam that resiliently flexes the contacts toward and against circuit conductors on the edge of the circuit board to establish electrical connections therewith. Each contact of the assembly includes a conductive post portion. A resilient spring blade of each contact is separate from the post portion. An electrical conductor portion is assembled and pivotally interlocked with the spring blade, and bridges between the post portion and a circuit conductor on the circuit board, to establish an electrical path therebetween that is shorter in length than the spring blade. The characteristic impedance of the path is readily controlled by dimensional adjustment of the contact. Each contact has self-inductance of less than 2 milli-Henry (mH) and capacitance under under 0.15 pico-Farads (pF). The interlocked conductor portion and spring blade are removable from an individual post portion to facilitate repair. The multiple post portions within a housing are simultaneously inserted into a circuit board that mounts the housing. Multiple housings are capable of stacking aside one another to provide a desired number of contacts along a single row, and to allow for individual compliant movement of the housings in response to thermal expansion or contraction of the circuit board.

An object of the invention is to provide a miniature, circuit board edge, connector assembly that incorporates electrical contacts of which their respective electrical paths are shorter than their spring lengths, and a cam resiliently flexes the contacts toward and away from circuit conductors on an edge of a circuit board that is received by an insulative housing that contains the contacts.

Another object of the invention is to provide a miniature circuit board edge connector that incorporates an insulative housing, conductive electrical contacts in the housing, a cam that resiliently flexes the contacts toward and away from a circuit board received by the housing, and each contact includes a resilient spring blade and a conductive post and an electrical conductor portion, that is pivotally interlocked with the spring blade, and that bridges between the conductive post and a circuit conductor of the circuit board, to provide a conductive electrical path, therebetween, that is shorter in length than the length of the spring blade.

Another object of the invention is to provide a miniature electrical connector assembly of the type in which electrical contacts are within an insulative housing, a movable cam urges the contacts toward and away from an edge of a circuit board, and conductive posts are associated with corresponding contacts and extend externally of the housing, and the contacts include resilient spring blades, electrical conductor portions are carried by corresponding spring blades and impinge corresponding posts, and the cam engages and resiliently flexes corresponding spring blades to urge the conductor portions toward and into compressed engagement with corresponding circuit conductors on the edge of the circuit board.

Another object of the invention is to provide a connector assembly, having the characteristics of the immediately previous paragraph, and further, a connector assembly in which each conductor portion pivotally interlocks with a corresponding spring blade and pivotally impinges a corresponding post, and the conductor portion is adapted to engage a corresponding circuit conductor upon flexure of the spring blade.

Another object of the invention is to provide a connector assembly according to either of the immediately previous two paragraphs, and further wherein, the cam includes an insulative blade mounted for rotation while engaging the spring blades, to cause resilient flexure of the spring blades.

Another object of the invention is to provide a connector assembly according to either of the immediately previous three paragraphs, and further, a connector assembly in which the housing has a series of compartments, the cam intersects each of the compartments, the spring blades are removably assembled in corresponding compartments, the spring blades engage the cam, and upon movement of the cam while against the spring blades, the conductor portions pivot toward and engage corresponding circuit conductors on a circuit board.

A better understanding of the invention will be apparent by way of example from the following description and the accompanying drawings in which.

Figure 1:
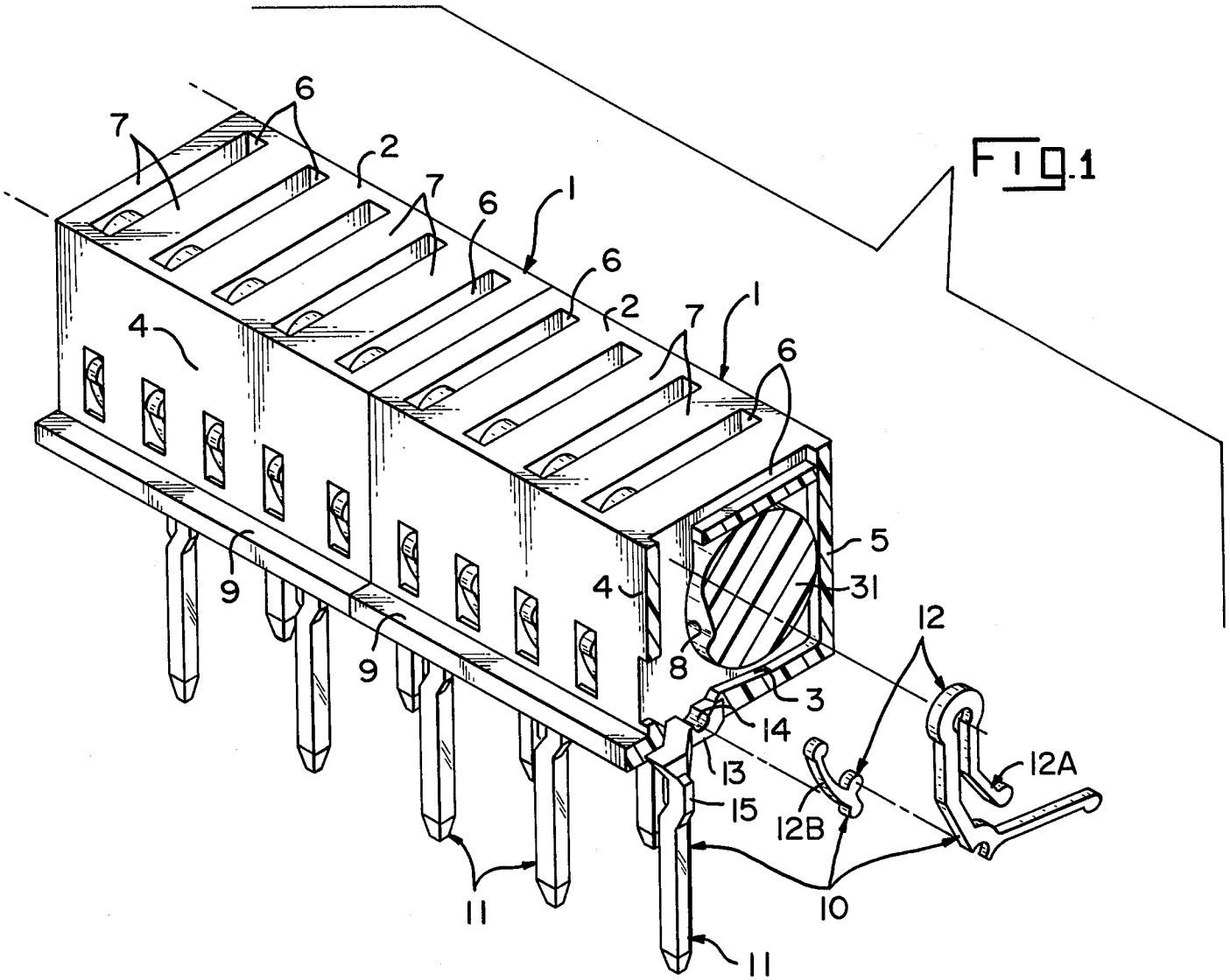
FIG. 1 is an enlarged perspective view of multiple electrical connector assemblies, according to the invention, for circuit conductors on one side of a circuit board edge.
Figure 2:
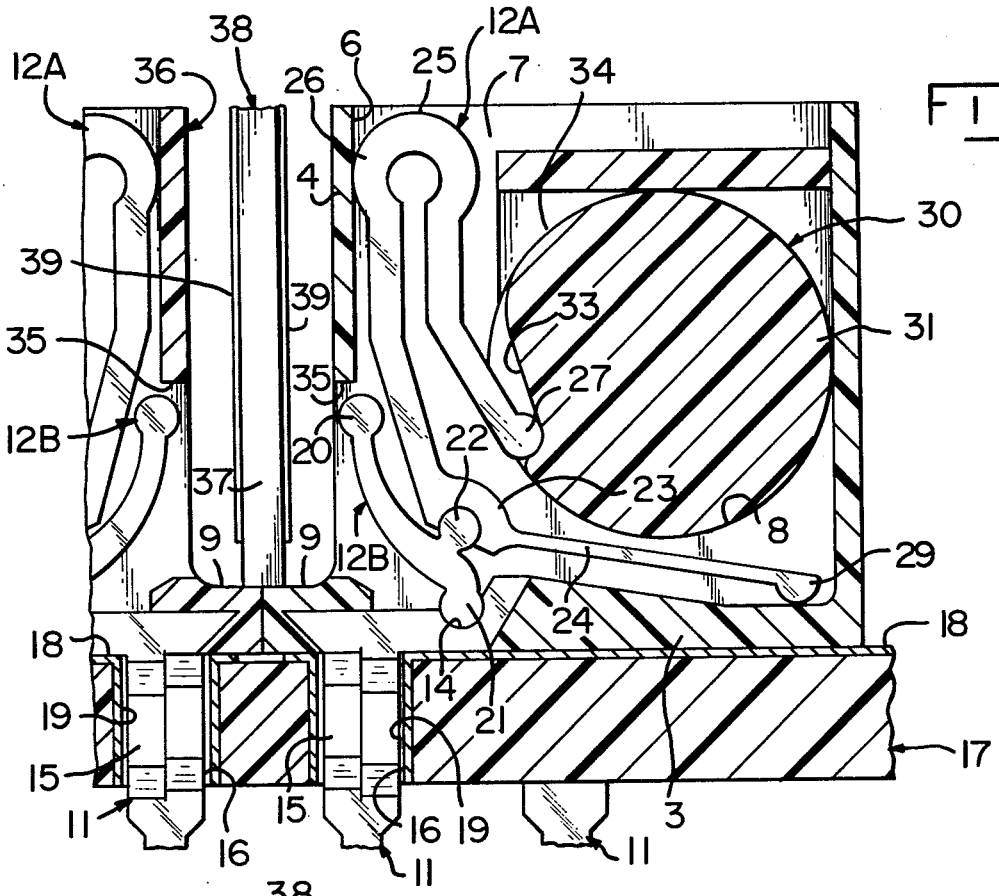
FIG. 2 is an enlarged fragmentary elevation view in section of a duplicate pair of connector assemblies cooperating to form a composite connector assembly for circuit conductors on two sides of a circuit board edge.

FIGS. 1 and 2 illustrate a connector assembly 1. An insulative housing 2 of the connector assembly 1 is molded of insulative plastics material and includes a hollow interior defined by a bottom wall 3 and outer side walls 4 and 5 integral with the bottom wall 3. The hollow interior is divided into open top compartments 6 by parallel, spaced apart barrier walls 7 integral with and spanning between the walls 4, 5. A cylindrical passageway 8 is adjacent the wall 5 and extends through the barrier walls 7 and intersects the compartments 6. A ledge 9 is molded as an integral extension of the bottom wall 3, and extends along the length of the wall 4.

Each compartment 6 contains a composite electrical contact 10, that includes a conductive post portion 11 and a resilient spring contact portion 12.

The post portion 11 of a corresponding contact 10 is stamped and formed in one piece from metal, and includes an integral base 13 that is imbedded in the bottom wall 3; for example, during molding of the housing 2. A rounded detent 14 in the base 13 is exposed in a corresponding compartment 6. The post portion 11 projects from the bottom wall 3 externally of the housing 2. The post portion 11 has a split portion 15, made as disclosed in U.S. Pat. No. 4,186,982.

The split portion 15 is adapted for a complaint, tight fit in a corresponding aperture 16 of a circuit board 17, thereby mounting the housing 2 on the circuit board 17. The circuit board 17 includes circuit conductors, one of which is shown, for example at 18, that extends over the surface of the circuit board 17 and also extends as a lining 19 in a corresponding aperture 16. The split portion 15 of a corresponding post portion 11 engages the lining 19 to establish a good electrical connection therewith.

The spring contact portion 12 is of two parts: A spring blade 12A and a conductive, conductor portion 12B. The conductor portion 12B is formed in one piece by being cut from and lifted from a flat sheet of metal, and is in the form of a lever having a free end 20 and an opposite, rounded free end 21. Intermediate the ends 20, 21 the contact portion 12B includes a protruding, rounded pivot 22. The spring blade 12A is formed in one piece by having been cut from and lifted from a flat sheet of metal, and includes a socket 23. Alternatively, the spring blade 12A may be formed from a flat sheet of glass or ceramic by any well known hot stamping operation. Because of its miniature size, the spring blade 12A undergoes very slight deflection that produces a strain well within the elastic limits of the glass material. Alternatively suited material is any nonmetallic material that does not exhibit cold flow characteristics. For example, plastics exhibit cold flow characteristics; i.e. inelastic deformation under stress at moderate temperatures, and is not suitable The socket 23 and pivot 22 are assembled by inlaying the pivot 22 into the socket 23. The pivot 22 remains pivotally interlocked with the socket 23 if the two parts 12A and 12B remain coplanar. As shown in FIG. 2, the assembled parts 12A and 12B are inserted into the open top of a corresponding compartment 6. The parts 12A and 12B are maintained coplanar by the corresponding barrier walls 7 that define the compartment 6. Thereby, the pivot 22 remains pivotally interlocked with the socket 23. The free end 21 of the conductor portion 12B is pivotally seated in the detent 14 of the base 13. The spring blade 12A includes an arcuate bowed portion 24, integral with the socket 23, and a portion 25 that is recurved and forms an integral brace portion 26 that impinges against the interior of the wall 4. A projection 27 is on an extended free end of the recurved portion 25. The recurved brace portion 26 is in the form of an eye, to provide a means to be grasped by a hook tool (not shown) to insert or remove the assembled contact parts 12A, 12B from the compartment 6. A free end 29 of the loop portion 25 registers against wall 3.

A cam 30 is comprised of an elongated cylindrical insulative blade 31 that projects along the passageway 8 and intersects the compartments 6. FIG. 1 shows multiples of the housing 2 interconnected by the blade 31. The length of the blades 31 may be varied for use with a sole housing 2 or multiples of the housing 2. The blade 31 has a series of recesses 32 having cam surfaces in the turn of inclined wedges 33 that are inclined toward the outer periphery of the blade and slidably impinge corresponding free ends 27.

Figure 3:
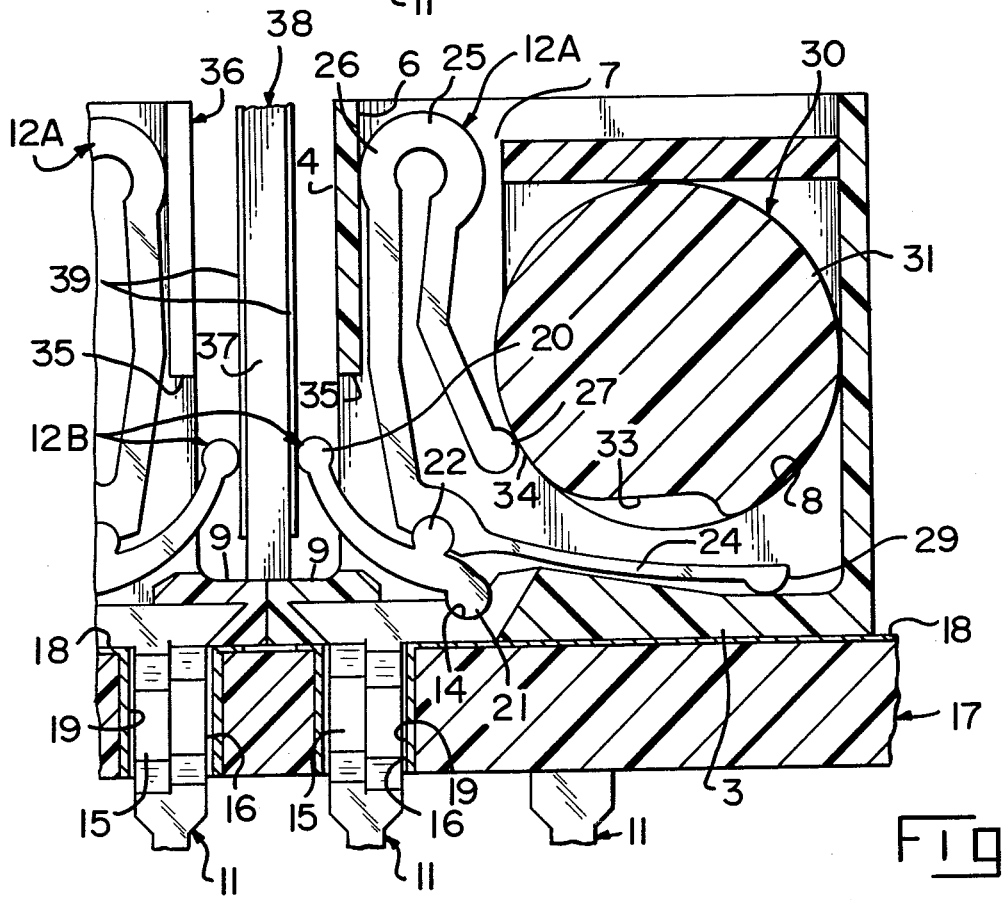
FIG. 3 is a view similar to FIG. 2 and illustrating electrical contacts in the pair of connector assemblies of FIG. 2 flexed resiliently by a cam to engage corresponding circuit conductors on the sides of a circuit board.

FIGS. 2 and 3 illustrate two assemblies 1, 1 mounted on the circuit board 17 with their ledges 9, 9 facing each other. The walls 4, 4 of the housings 2, 2 define opposite sides of a card edge receiving channel 36. An edge 37 of a circuit board 38 is inserted in the channel 36, or alternatively, withdrawn from the channel, without undue exertion against the contacts 10. Conductive, circuit conductors 39, on the surfaces of the circuit board edge 37, face openings 35 in the walls 4 of the assemblies 1, 1. The circuit board 38 is completely inserted when its edge 37 seats against the ledges 9, 9. The assemblies 1, 1 are useful for establishing electrical connections of the circuit conductors 39 to the circuit conductors 18. This is accomplished by the following operation of the assemblies 1, 1.

The blade 31 is rotated manually by an operator alternately between a first position shown in FIG. 2 and a second position shown in FIG. 3. The wedges 33 slidably impinge and drive the free ends 27 radially toward or away from the blade 31. Thereby, the blade 31 is forced to translate against and flex the spring blades 12A. Thereby, each spring blade 12A undergoes resilient flexure, such that its socket 23 is pivoted alternately to and fro; i.e., toward and away from the base 13. The conductor portion 12B is pivoted, alternatively to and fro, and about its pivot 21 that remains pivotally seated in the detent 14 of the base 13. The free end 20 of the conductor portion 12B pivots, to and fro; i.e., from its position, shown in FIG. 2, to a position, outwardly of an opening 35 in the wall 4. The free end 12B engages a corresponding circuit conductor 37, and establishes an electrically conductive path, along the conductor 12B and from the circuit conductor 37 to the base 13. The length of the conductive path is shorter than the length of the spring blade 12A. The spring energy from the resiliently flexed spring blade 12A compresses the conductor 12B against both the circuit conductor 37 and the base 13 to establish good electrical connections therewith. The spring energy also assures that the conductor is pivoted sufficiently to engage and compress against a circuit board of any width that fits in the channel. Further, the term "circuit board" is intended to include any board, card or substrate on which electrical circuit conductors are secured by printing, plating or other analogous process. The invention is intended to include also a single assembly 1 for a circuit board on which circuit conductors are soley on one surface of the board that faces the assembly 1 and an edge of the circuit board is seated on a ledge 9 of the assembly 1.

The spring blades 12A and conductors 12B are shaped soley by cutting a flat sheet of material. No bending or forming of the material is required. Therefore, the parts 12A and 12B may be of miniature shapes that do not tend to change by unbending or relaxation. The housing 2 is approximately one-half inch in width, from the wall 4 to the wall 5, and one-half inch in height from the bottom wall 3 to the top of the housing 2. The compartments 6 in the housing interior occur every 0.05 inches minimum along the housing length. One or more housings 2 are mounted along the cam and insertable as a unit on the circuit board. The plural housings are mounted moveably on the cam for compliant movement in response to thermal expansion or contraction of the circuit board.

We claim:

1. A miniature circuit board edge connector assembly comprises an insulative housing, conductive posts projecting from the housing, spring contacts received by the housing and connected with the posts and adapted for resilient flexure toward corresponding circuit conductors on a circuit board that is received by the housing, and a moveable cam received by the housing and adapted for flexing resiliently the spring contacts, characterized in that; the spring contacts include conductor portions, pivot connections between the conductor portions and corresponding posts and the conductor portions being pivotal about the pivot connections toward and into engagement with corresponding circuit conductors, the cam is cylindrical with recesses impinged by the spring contacts and circuit paths are established along the conductor portions from the circuit conductors to corresponding posts, the circuit paths being shorter than the lengths of the spring contacts.

2. A connector assembly according to claim 1, further characterized in that; the contacts include resiliently flexible spring blades, the conductor portions are pivotally interlocked with the spring blades, and the spring blades impinge the recesses of the cam and are adapted for resilient flexure by the cam.

3. The connector assembly according to claim 2, further characterized in that; the housing has a series of compartments, the spring blades are removably assembled in corresponding compartments, the cam intersects the compartments and impinges the spring blades, and upon movement of the cam against the spring blades, the conductor portions pivot toward and engage corresponding circuit conductors.

4. The connector assembly according to claims 1 or 2 further characterized in that; each spring blade has a bowed and recurved form obtained by having been cut from and lifted out from a flat sheet of metal.

5. The connector assembly according to claims 1 or 2 further characterized in that; each spring blade has a form obtained by having been cut from and lifted out from a flat sheet of metal, each spring blade form includes a socket pivotally interlocked with corresponding conductor portions, a brace in registration against the housing, and a curvilinear portion integral with the socket and the brace, the curvilinear portion engaging the cam and being adapted for resilient flexure by movement of the cam.

6. The connector assembly according to claims 1 or 2, further characterized in that; the housing comprises a plurality of housing sections mounted along the cam and insertable as a unit on the circuit board.

7. The connector assembly according to claims 1 or 2, further characterized in that; the housing comprises a plurality of housing sections that are mounted on the circuit board for compliant movement in response to thermal expansion or contraction of the circuit board.

8. The connector assembly according to claims 1 or 2, further characterized in that; the contacts are individually removable from associated compartments and associated post to facilitate repair.

9. The connector assembly according to claims 1 or 2, further characterized in that; the contacts have nonconductive portions of nonmetallic material that does not exhibit cold flow characteristics.

10. The connector assembly according to claims 1 or 2, further characterized in that; each contact has self-inductance of less than 2 mH and capacitance under 0.15 pF.

* * * * *